United States Patent [19]

Suprunov et al.

[11] 4,051,602

[45] Oct. 4, 1977

[54] KILN FOR THE THERMAL TREATMENT OF SLURRY TYPE MATERIALS SUCH AS MAGNESITE

[75] Inventors: Vladimir Suprunov; Alfred Kryczun; Theodor Manshausen, all of Cologne, Germany

[73] Assignee: Klockner-Humboldt-Deutz Aktiengesellschaft, Germany

[21] Appl. No.: 654,643

[22] Filed: Feb. 2, 1976

[30] Foreign Application Priority Data

July 4, 1975 Germany ..... 2529847

[51] Int. Cl.[2] ..... F26B 3/08; F26B 17/00

[52] U.S. Cl. ..... 34/10; 34/17; 34/57 E; 34/59

[58] Field of Search ..... 34/10, 17, 59, 57 E; 159/4 CC, 48 R, 48 L

[56] References Cited

U.S. PATENT DOCUMENTS

| | | | |
|---|---|---|---|
| 2,240,854 | 5/1941 | Peebles | 34/57 E |
| 2,636,555 | 4/1953 | Klepetko et al. | 159/4 C |
| 2,823,742 | 2/1958 | Ludin et al. | 159/24 |
| 3,212,197 | 10/1965 | Crawford | 34/10 |
| 3,547,179 | 12/1970 | Hussman | 159/4 CC |
| 3,871,111 | 3/1975 | Porr | 34/59 |

*Primary Examiner*—John J. Camby

*Attorney, Agent, or Firm*—Hill, Gross, Simpson, Van Santen, Steadman, Chiara & Simpson

[57] ABSTRACT

The method and mechanism for thermally treating a slurry of material such as a magnesite hydrate wherein a kiln housing has an upper chamber portion and a lower chamber portion with spray nozzles in the roof of the upper chamber for directing a spray of slurry downwardly and a rotor with arms in the lower portion and separators forming a plurality of tiers in the lower portion with heated gases directed tangentially into the chamber at the base of the upper portion and additional gases directed into the lower portion with the heat treated material being drawn from the base of the chamber and evaporated moisture withdrawn from the top of the chamber, and dust separated from the moisture and reintroduced into the chamber.

10 Claims, 1 Drawing Figure

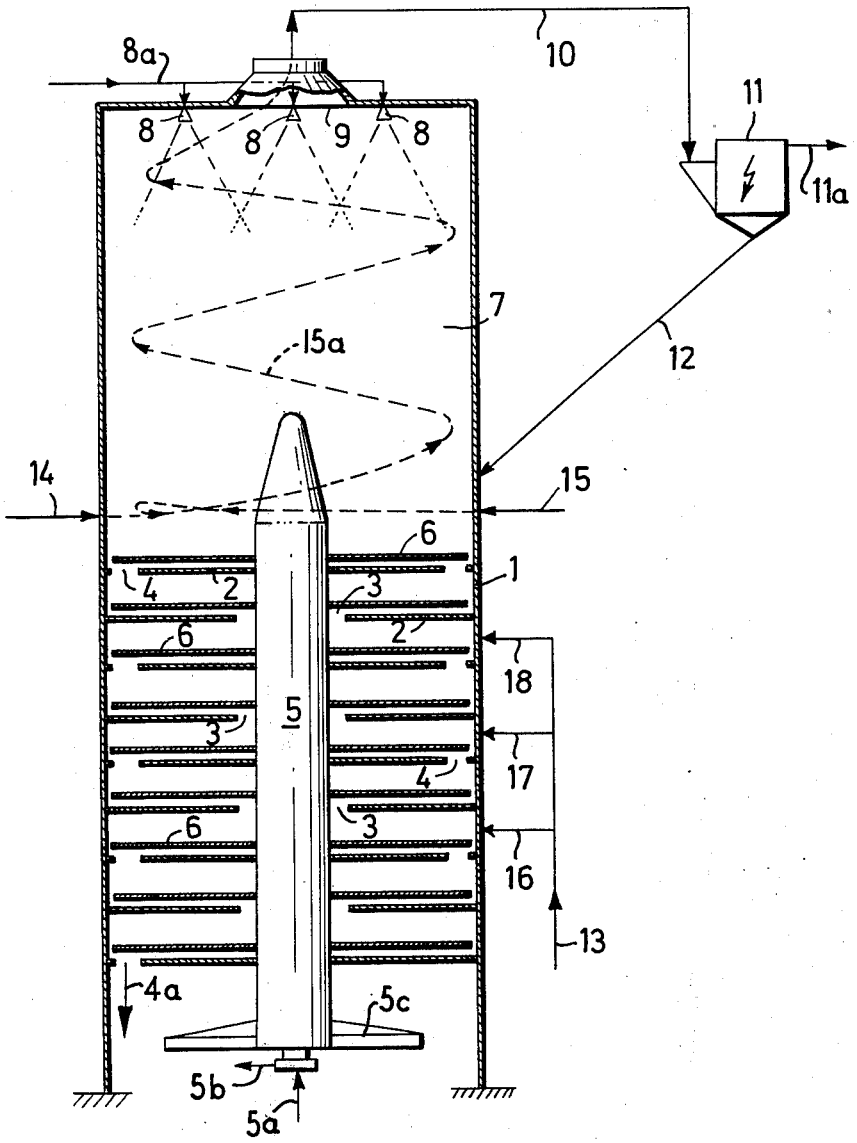
8a
10
11
11a
8
8
9
8
7
15a
12
14
15
6
1
4
2
3
2
6
18
5
3
17
4
3
6
16
13
4a
5c
5b
5a

KILN FOR THE THERMAL TREATMENT OF SLURRY TYPE MATERIALS SUCH AS MAGNESITE

BACKGROUND OF THE INVENTION

The invention relates to an improved kiln for heat treating slurries of material such as magnesite hydrate slurries.

In kilns which have been provided heretofore, overlying beds have been provided for the thermal treatment of materials, but in order to obtain adequate treatment, the kilns have been very tall requiring a great deal of space and requiring expensive construction. This type of construction has also required a high expenditure of thermal energy. In accordance with the concepts of the present invention, the height of the kiln chamber is greatly reduced, and the thermal energy and mechanical energy requirements are reduced with a commensurate improvement in operation and in the product obtained.

It is accordingly an object of the present invention to provide an improved thermal treatment kiln for the treatment of material such as magnesite hydrate wherein the operation is such that the required height of the kiln is reduced considerably over that which was necessary by methods heretofore practiced.

A further object of the invention is to provide a kiln construction which operates in accordance with a method that reduces the energy input required and insures trouble-free continuous operation with improved efficiency for an improved more consistent product.

In accordance with the principles of the invention, the structure embodies a kiln wherein the chamber therein has an upper portion and a lower portion. The upper portion is constructed as a spray chamber having nozzles arranged in the ceiling and/or the walls. The upper portion of the chamber provides a predrying or predehydrating chamber which prepares the material to such an extent that the material therein can be sintered or calcined in considerably fewer tiers of treatment than were heretofore required. The completion of calcining is done in the lower portion of the chamber wherein the material is passed through a series of tiers while continuing to be subjected to heated gases.

In accordance with the invention, the upper portion of the chamber has a centrally located gas vent outlet with the spray nozzles for spraying the slurry arranged circumferentially around the opening to spray the slurry downwardly. Heated gases are directed into the lower part of the upper chamber tangentially so that they ascend in a spiral path flowing countercurrent to the downwardly sprayed flow of slurry.

In accordance with the principles of the invention, a preferred arrangement provides that the height of the upper chamber, that is, the height from the uppermost tier of the lower chamber to the ceiling of the spray chamber is at least twice as great as the spacing between the tiers. By directing the gases tangentially into the upper chamber, the counterflow of gas engaging the downwardly sprayed slurry materials suspends them in their movement so as to prolong the predrying or preconditioning of the material and intensify this phase of the process.

Other objects, advantages and features of the invention, as well as equivalent structures and methods, which are intended to be covered herein, will become more apparent with the teaching of the principles of the invention in connection with the disclosure of the preferred embodiments in the specification, claims, and drawings, in which:

DRAWINGS

The single FIGURE of the drawing is a somewhat schematic elevational view shown in section of a kiln constructed and operating in accordance with the principles of the present invention.

DESCRIPTION OF THE PREFERRED EMBODIMENTS

The drawing shows a kiln with an outer housing wall 1 of fireproof material which is preferably cylindrical in shape and has a flat roof. The cylindrical housing wall 1 forms a kiln chamber therein which has an upper chamber portion 7 which is the spray chamber, and a lower chamber portion. Within the lower chamber are a plurality of tiers formed by hearths 2 which are supported on the wall 1 of the chamber and have openings such as illustrated at 3 and 4 which are staggered. As illustrated, the openings for one tier will be at the center, and for the next successive tier, will be outwardly thereof so that the material must pass back and forth and travel transversely over each hearth surface as it moves downwardly.

To aid in processing the material as it passes through the lower portion of the chamber over the hearth, is a central rotor which has a hollow central shaft 5 and a plurality of radially extending arms 6. The arms will be provided with blades, not shown, which will aid in moving the material across the hearth.

The kiln is mounted on a support floor, and at the lower end of the kiln, it is open to remove the treated material which flows downwardly as shown by the arrowed line **4*a***.

To cool the rotor, the hollow shaft 5 is provided with an inlet line **5*a* which admits cooling water an an outlet line 5*b* which provides for the cooling water to leave the hollow shaft 5. By cooling the shaft, heat is removed from the arms for continued operation. The shaft is provided with a suitable means to drive in rotation shown schematically at 5*c***.

The upper chamber 7 of the furnace is provided with spray nozzles 8 in the roof which are arranged around the gas outlet opening 9. The opening 9 is preferably centrally located, and leads to a conduit 10 which connects to a dust separation filter 11. The filter separates the dust from the moisture vapor and gases which passes out through the top of the furnace, and the separated dust is collected and passed down through a conduit back into the furnace at the upper end of the lower chamber so that the dust will pass down through the tiers of the lower chamber portion. After the dust is separated, the gases and moisture are discharged in the filter through line **11*a***.

Heated gas is supplied to the chamber from combustion chambers which may be a conventional types and are omitted from the drawing. The heated gas is supplied through the chamber through lines 13, 14 and 15.

In the lower portion of the chamber, the heated gas supplied through the line 13 is directed into the chamber through the distribution lines 16, 17 and 18 which feed radially into the furnace into the different tiers. Heated gas flows through the material on the hearths, and then flows upwardly into the upper portion of the furnace.

A separate first supply of gas is provided in the upper portion through the lines 14 and 15 which are positioned to direct the flow tangentially into the furnace so that it flows upwardly as indicated generally by the dotted line 15*a*. The flow of gases will follow a general spiral path as they flow upwardly, and the direction of flow will be countercurrent to the slurry which is sprayed through the spray nozzles 8.

The gas which is introduced through the line 13 is at a temperature preferably in the range of 1,000° C to 1,300° C. The gas which is introduced into the lines 14 and 15 is preferably at a temperature between 1,200° C and 1,500° C. In operation a slurry of material to be treated such as magnesit hydrate is directed under pressure through a supply line 8*a* to be sprayed downwardly in the upper portion of the chamber through the nozzles 8, and this downwardly flowing spray is suspended being predried and pretreated by the upward flow of heated gases. As the water evaporates from the slurry, dust is formed passing out with the vapor through the opening 9 and the electrofilter 11 removes the dust which is directed back through the line 12.

Other solids pass downwardly from the upper chamber onto the tiers found by the hearths, beginning with the upper hearth 6. The solids then continue to be heat treated passing downward through the various tiers. The finished product whch is magnesium oxide is drawn off downwardly and essentially cools as it reaches the lowermost tiers below the heated gas supply line 16. The material then is drawn off from the furnace to be supplied to other equipment for further treatment.

While in the preferred form the spray nozzles are in the roof of the upper chamber, it will be understood that they may be arranged circumferentially around the outer wall in the upper chamber. Also, a combination of roof nozzles and outer wall nozzles may be employed.

Thus, there has been provided a furnace for the thermal treatment of slurry type materials which permits a high transfer of thermal energy to the materials in a furnace of a lower height than heretofore required. The effectiveness and efficiency is improved over devices heretofore available. By the pretreatment in the upper chamber, improved effects are attained on the lower hearths, and improved more uniform product is attained.

We claim as our invention:

1. A kiln for thermally treating a slurry of material such as a magnesite hydrate including:

a kiln housing defining a treatment chamber therein having an upper chamber portion with a ceiling and a lower chamber portion;

spray nozzles in said upper chamber distributed over said ceiling for directing a spray of slurry of material downwardly into the chamber;

means situated on the chamber wall positioned for directing heating gases tangentially into the kiln chamber below the spray nozzles at the lower end of the upper chamber so that drying of the material occurs across the entire cross section of the chamber;

and a plurality of horizontally extending vertically spaced overlying beds in said lower chamber with openings for material to descend downwardly while being heat treated;

said housing having an opening at the lower end for removal of heat treated material;

said housing having a gas removal opening at the upper end so that said heating gases flow upwardly out of the chamber with the evaporated moisture and flow counter-current to the sprayed slurry.

2. A kiln for thermally treating a slurry of material such as a magnesite hydrate in accordance with claim 1:

including a rotor in the lower end having a plurality of arms projecting therefrom into said beds; and a hollow central hub for said rotor with means for directing a flow of coolant through the hub to cool the arms.

3. A kiln for thermally treating a slurry of material such as a magnesite hydrate in accordance with claim 1:

including a dust separator connected to the gas removal opening at the upper end of the chamber for separating dust from evaporated moisture emitted from the chamber with means for redirecting the separated dust back into the kiln chamber.

4. A kiln for thermally treating a slurry of material such as a magnesite hydrate in accordance with claim 1:

wherein said chamber is cylindrical in shape with a roof portion and said spray nozzles are positioned in the roof with said gas removal opening being centrally located.

5. A kiln for thermally treating a slurry of material such as a magnesite hydrate in accordance with claim 1:

including a second means for directing heated gases located in the lower chamber portion below said first means.

6. A kiln for thermally treating a slurry of material such as a magnesite hydrate in accordance with claim 5:

wherein the second gas directing means direct gas into the lower part of the chamber at a temperature in the range of 1,000° to 1,300° C and the first gas directing means directs gases into the chamber at a temperature in the range of between 1,200° C to 1,500° C.

7. The method of thermally treating a slurry of material such as a magnesite hydrate including the steps:

spraying the material into the upper end of a kiln chamber at the roof;

introducing heated gases in a distributed pattern at a first location tangentially at the lower end of an upper portion to flow upwardly countercurrent to the downward movement of the sprayed slurry of material and drying over the entire area of the chamber;

drawing off evaporated moisture at the top of the chamber;

and removing the heat treated material from the lower end of the chamber.

8. The method of thermally treating a slurry of material such as a magnesite hydrate in accordance with the steps of claim 7:

including separating dust from the evaporated moisture removed from the top of the chamber and redirecting the separated dust back into the chamber.

9. The method of thermally treating a slurry of material such as a magnesite hydrate in accordance with the steps of claim 7:

including directing heated gases additionally at a second location below said first location.

10. The method of thermally treating a slurry of material such as a magnesite hydrate in accordance with the steps of claim 9:

wherein the temperature of the gas directed into the chamber at the first location is in the range of 1,200° C to 1,500° C and at the second location is in the range of 1,000° to 1,300° C.

* * * * *